United States Patent [19]

Wahhoud et al.

[11] Patent Number: 5,031,672

[45] Date of Patent: Jul. 16, 1991

[54] NOZZLE CONTROL DEVICE WITH CLOSED LOOP CONTROL CIRCUIT FOR AN AIR WEAVING LOOM

[75] Inventors: Adnan Wahhoud, Lindau; Dieter Teufel, Langenargen; Jochen Balken, Lindau, all of Fed. Rep. of Germany

[73] Assignee: Lindauer Dornier Gesellschaft mbH, Lindau/Bodensee, Fed. Rep. of Germany

[21] Appl. No.: 458,728

[22] PCT Filed: Jun. 1, 1989

[86] PCT No.: PCT/EP89/00617

§ 371 Date: Jan. 31, 1990

§ 102(e) Date: Jan. 31, 1990

[87] PCT Pub. No.: WO89/12122

PCT Pub. Date: Dec. 14, 1989

[30] Foreign Application Priority Data

Jun. 2, 1988 [DE] Fed. Rep. of Germany ..... 3818766

[51] Int. Cl.[5] ..... D03D 47/30

[52] U.S. Cl. ..... 139/435.2; 139/435.5

[58] Field of Search ..... 226/95; 139/435.5, 435.2

[56] References Cited

U.S. PATENT DOCUMENTS 4,463,783 8/1984 Suzuki et al. ..... 139/435.2
4,646,791 3/1987 Tsuji et al. ..... 139/435.5 X
4,651,785 3/1987 Volland et al. ..... 139/435.5 X
4,673,004 6/1987 Rosseel et al. ..... 139/435.5 X

FOREIGN PATENT DOCUMENTS 0164773 12/1985 European Pat. Off. .
0189919 8/1986 European Pat. Off. .
0263445 4/1988 European Pat. Off. .
SE/8300446 6/1984 PCT Int'l Appl. .

*Primary Examiner*—Andrew M. Falik
*Attorney, Agent, or Firm*—W. G. Fasse; D. H. Kane, Jr.

[57] ABSTRACT

A nozzle control device for an air weaving loom has a weft thread insertion by one or more main nozzles and a feed advance of the yarn in the air insertion channel by relay nozzles arranged one behind the other at the weaving reed. The relay nozzles are controlled in groups and in sequence in an impulse type manner in such a way that the thread tip zone is seized by the air stream and the thread is pulled through the air insertion channel. The control of the relay nozzles of an air weaving machine is accomplished in such a way that in sequential work steps substantially different types of yarns can be woven with a high quality. For this purpose the durations of air impulses supplied to the relay nozzles arranged in groups, are controlled as a function of yarn specific values modified by a currently measured air effectiveness of the respective yarn being processed.

5 Claims, 3 Drawing Sheets

NOZZLE CONTROL DEVICE WITH CLOSED LOOP CONTROL CIRCUIT FOR AN AIR WEAVING LOOM

FIELD OF THE INVENTION

The invention relates to a nozzle control device for an air jet weaving loom with a weft thread insertion by one or more main nozzles and by a plurality of relay nozzles arranged along a weft thread insertion air channel.

BACKGROUND INFORMATION

The weft thread insertion in conventional air weaving looms takes place through one or several main nozzles, whereby each main nozzle is coordinated with one yarn. The main nozzles are arranged in bundles and so centered on the air insertion channel that each time one yarn can be carried into the air insertion channel.

The yarn is transported through the weft thread insertion air channel in that an air guiding of the weft thread through the insertion air channel takes place by means of relay nozzles arranged in a row along the insertion air channel through the weaving reed.

Heretofore, the relay nozzles have been controlled in sequence in an impulse type manner, so that the thread tip was seized by the air stream for pulling the thread through the insertion air channel.

It has been a disadvantage in conventional controls of the relay nozzles in air weaving looms that the impulse duration of the control of the relay nozzles had to be adjusted to the thickest thread which is least air effective. It was necessary to take care that the heaviest thread was still sufficiently exposed along its length to the air flow, so that even the thickest thread achieved the speed sufficient for its transport through the insertion air channel. Supplying air in accordance with the requirements of the heaviest thread has the disadvantage that, if less heavy yarns are simultaneously woven, these lighter more air effective yarns receive too much air, whereby the excess air is wasted. On the one hand, the wasted air caused a disadvantageously high air consumption and, on the other hand, it involved the danger of damaging the yarn. In bad cases it was no longer possible to weave substantially different yarns into the same fabric.

OBJECTS AND SUMMARY OF THE INVENTION

It is an object of the invention to further develop the control device of the relay nozzles of an air weaving machine in such a manner that in sequential work steps substantially different yarns can be woven with a high quality.

For achieving the above object the invention is characterized in that the relay nozzles are controlled in groups and in that the air impulse duration of the control device is controlled in a closed loop manner in response to the air effectiveness of the respective yarn being woven, whereby said air effectiveness or its relevant parameter is currently measured automatically and the respective signal is used in said closed loop control for controlling said air impulse duration.

The ratio of the supporting surface of the yarn in air, relative to the yarn mass is defined as a parameter of the air effectiveness. Thus, it becomes clear that light yarns require a different control of the air nozzles than comparatively heavy yarns.

According to a further embodiment of the invention, a known parameter of the air effectiveness of a particular yarn type is also taken into account for the control by manual insertion of the known parameter into a control device by means of an operating terminal.

In another embodiment the current relevant parameters of the yarn are ascertained by way of a thickness measurement. Such a measurement provides information regarding the hairiness of the weft thread which is directly relevant to the air effectiveness of that weft thread. The specific or current parameters of the yarn can be ascertained capacitively by sensors measuring an electrical capacity that may change along the length of a weft thread as the latter passes through the sensor.

According to a further embodiment of the invention, the sensor output signals representing the parameters of the weft thread yarn as it is pulled off a supply spool, are supplied to an electronical control device including a computer, wherein the specific yarn parameters relating to the air effectiveness, are calculated from said sensor signals to provide impulse duration control signals to the relay nozzles controlled in groups, which are adjusted depending on such control signals.

Light yarns require only a short air impulse for their transport, especially at the outlet of the weft insertion air channel in the stretching phase, whereby the impulse duration for light yarns differs only immaterially from the impulse duration at the input of the weft insertion air channel.

For heavy yarns an air impulse of a determined length is produced at the inlet of the weft insertion air channel and the air impulse at the output of the weft insertion air channel in the stretching phase, is lengthened substantially compared to the air impulse length at the inlet.

For light yarns it is, for example, necessary in the stretching phase to carry the thread only by two relay nozzle groups, whereas for heavy yarns it is necessary to have the thread carried by three relay nozzle groups which are controlled simultaneously.

These required different controls are automatically recognized by the computer depending on the yarn qualities manually inputted or automatically supplied as currently measured by the sensors, according to the invention, whereby the relay nozzles are respectively controlled for different durations.

In a further embodiment of the present invention the main nozzles are controlled in addition to the relay nozzles, in such a manner that by way of sensors in connection with an electronic control device, the starting point of the yarns is determined when the yarn is introduced into the weft insertion air channel. Thus, the advantage exists that in spite of different thread speeds which a light yarn has in the insertion air channel as compared to a heavy yarn, the threads arrive simultaneously at the exit side of the air weaving machine.

Another advantage is seen in that the length of the stretching phase, that is the time for the stretching of the yarn is the same for both types of yarns. Thus, a substantial saving of air is achieved for the groups of relay nozzles allocated to the stretching phase, because these require only a relatively short duration control.

BRIEF DESCRIPTION OF THE DRAWINGS

The invention will be explained in more detail in the following with reference to an example embodiment shown in the accompanying drawings, wherein:

FIGS. 2 and 3 shows time (t) in milliseconds and the abscissa shows the distribution of the relay nozzle groups along the weaving width of the loom.

DETAILED DESCRIPTION OF A PREFERRED EMBODIMENT AND OF THE BEST MODE OF THE INVENTION

Figure 1:
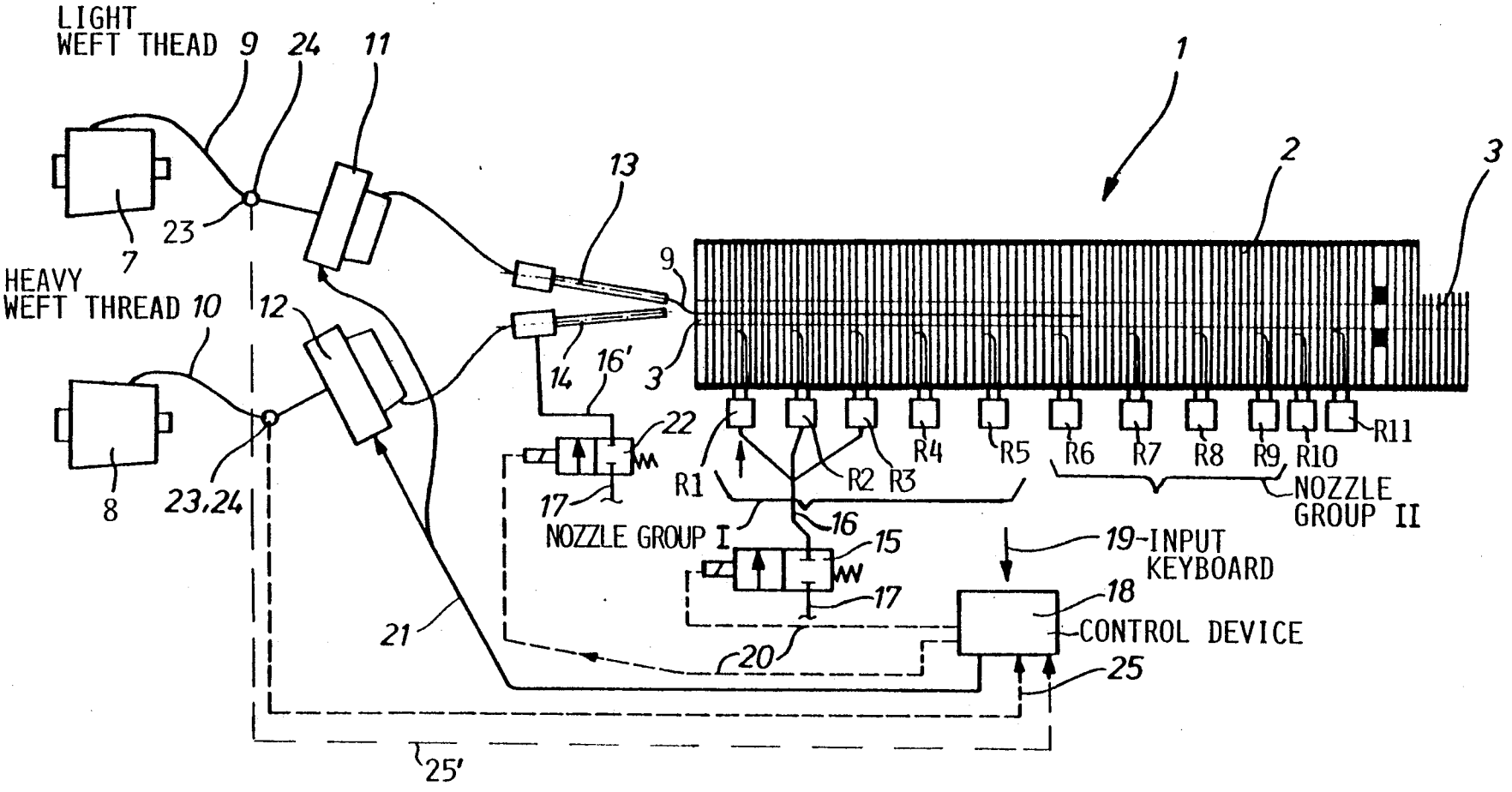
FIG. 1 is a schematic plan view of the weft thread insertion components of an air jet loom equipped with sensors for measuring the current air effectiveness of the several weft threads.

The air weaving machine 1 according to FIG. 1 comprises a weaving reed 2 in which an insertion air channel 3 is formed.

Figure 2:
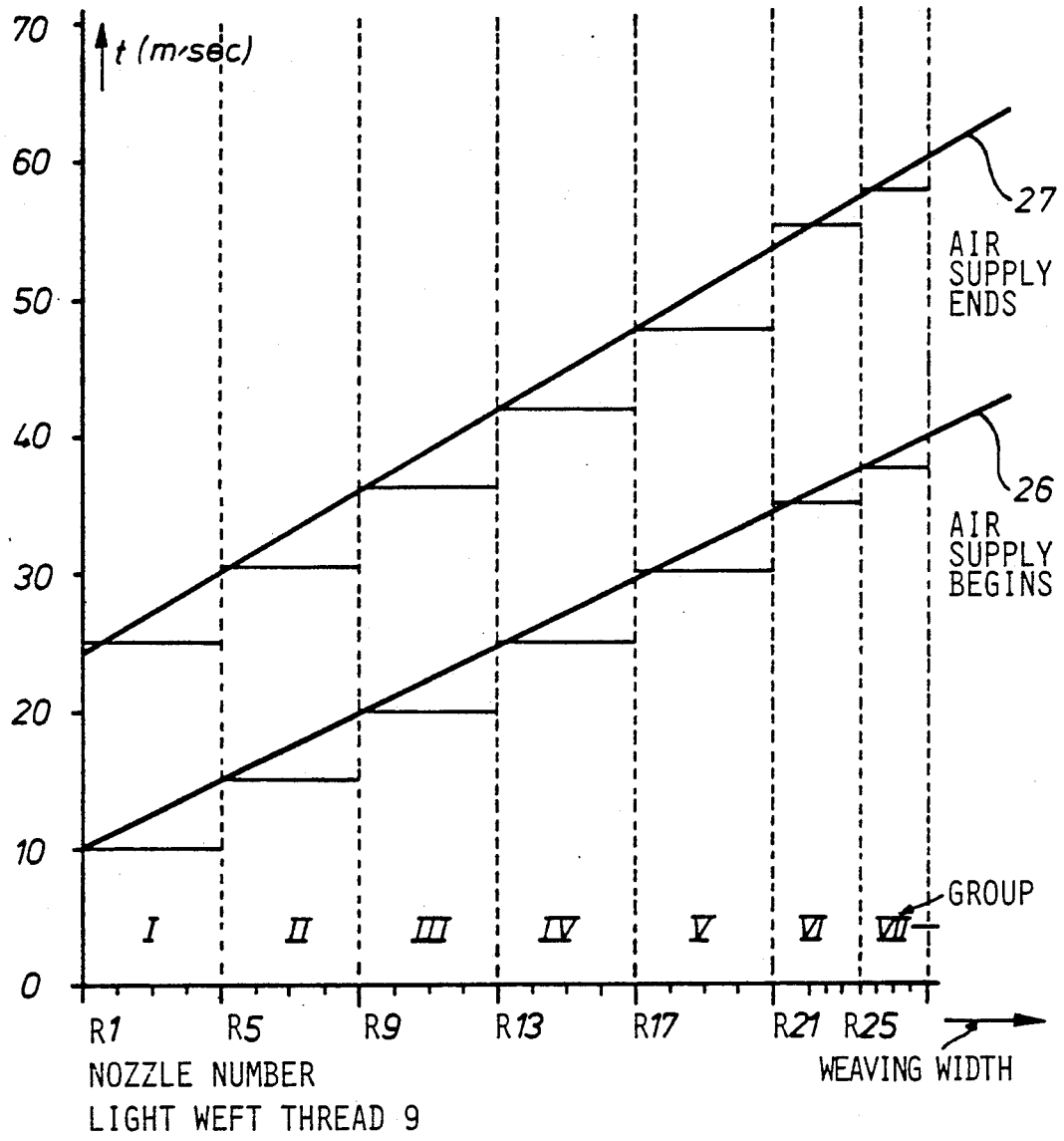
FIGS. 2 and 3 illustrate details of the impulse duration control, whereby the ordinate in both
Figure 3:
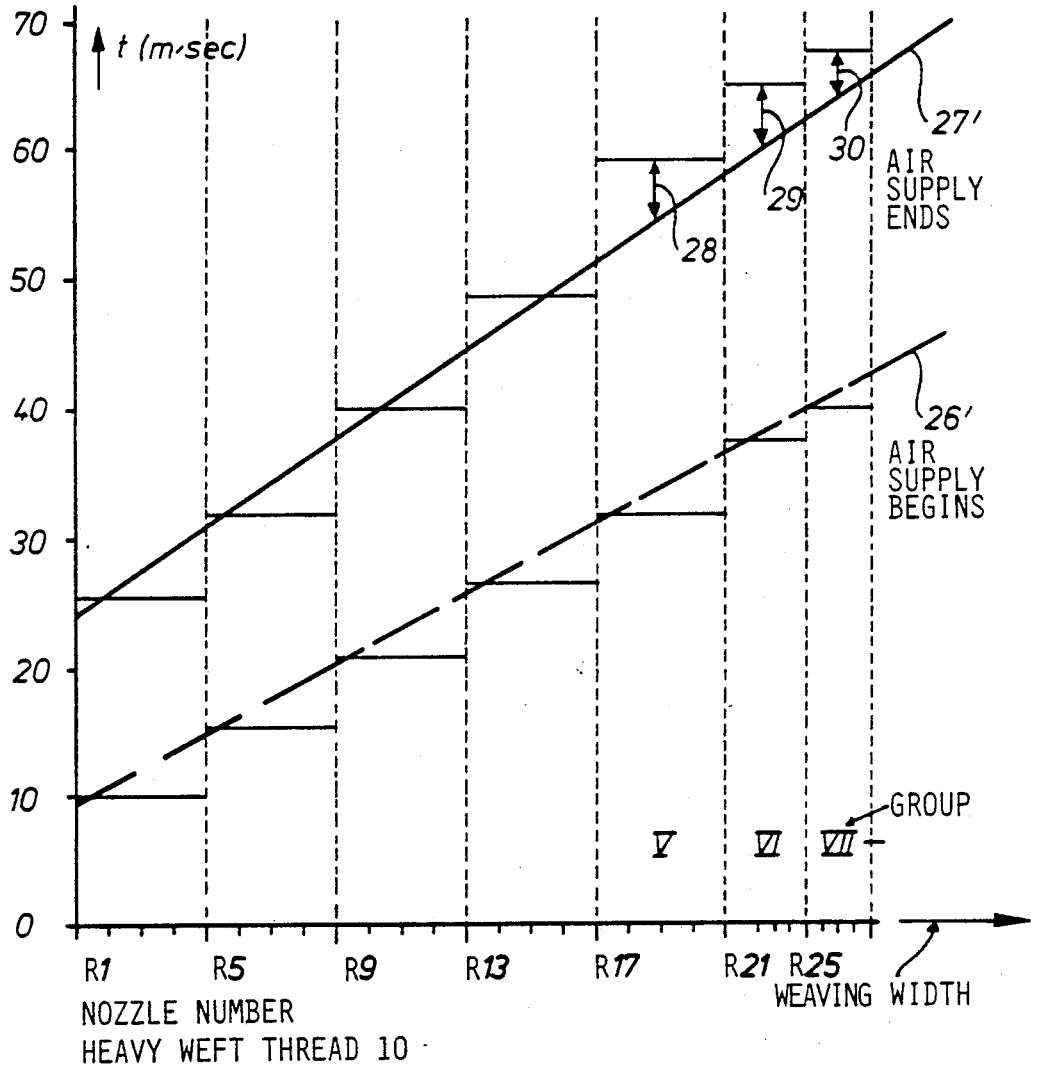

A plurality of relay nozzles R1 to R25 are arranged in a row extending in parallel to the insertion air channel in the weaving reed 2, whereby the relay nozzles R1 to R25 form nozzle groups I, II, . . . and so forth. In FIGS. 2 and 3 seven nozzle group numbers I, II, III, IV, V, VI, and VII are shown.

Each nozzle group I, II, . . . is controlled by a respective electromagnetic valve 15 connected through a pressurized air conduit 16 to the nozzles of its group and with a conduit 17 to a pressurized air supply not shown. The valve 15 is constructed as an electromagnetic two-way-valve.

The valve 15 is controlled through an electrical conductor 20 connected to a control device 18 having an input terminal 19 such as a keyboard merely indicated schematically by an arrow.

The yarn insertion side of the air weaving machine 1 is formed by a plurality of yarn reels 7, 8, whereby a weft thread 9, 10 is pulled off each yarn reel 7, 8. Each weft thread is supplied to its respective preliminary reeling device 11, 12 through sensors 23 which currently measure the air effectiveness of the respective weft threads 9, 10.

From the preliminary reeling device 11, 12, the yarn is guided to a respective main nozzle 13, 14 by an impulse controlled rod. The main nozzles 13, 14 insert the respective weft thread 9, 10 into the insertion air channel 3. The main nozzles 13, 14 are also controlled in their air supply by electromagnetic valves 22 which are under the control of the control device 18.

In accordance with the control of the magnetic valves 15 and 22 the air from a source of pressurized air, is supplied through the conduit 17 to the respective output conduit 16' leading to the main nozzles 13, 14, and conduit 16 leading to the relay nozzles R1, R2, . . .

According to the invention, each weft thread 9, 10 passes through its sensor 23, for example a capacitive sensor, which provides at its output an electrical signal representing the current air effectiveness of the respective weft thread 9, 10 along its length as the thread moves through the sensor 23. The thread thickness and thus its hairiness may be measured capacitively, for example, whereby the signals produced electronically by the sensors 23 are supplied to the control device 18 through signal conductors 25, 25'. The control device 18 processes these signals representing the currently measured air effectiveness of the weft threads 9, 10 to provide respective control signals on the conductors 20 for controlling the magnetic valves 15 and 22 leading to the relay nozzles R1 . . . and to the main nozzles 13, 14 respectively, in accordance with the control signal. The sensors 23 may be combined with conventional thread guides 24.

FIGS. 2 and 3 disclose further details of the control. In both FIGS. 2 and 3 the weaving width and the relay nozzle group numbers I to VII are plotted along the abscissa. The individual nozzle numbers R1 to R25 are indicated below the abscissa. The time is plotted in milliseconds along the ordinate. A slanted line 26 in FIG. 2 indicates the beginning of the air blowing operation of the relay nozzle groups I, II, . . . for transporting a light weft thread 9 through the air insertion channel 3. A further slanted line 27 in FIG. 2 indicates the end of the air blowing operation. Similarly, in FIG. 3 a line 26' marks the beginning of the air blowing while line 27' marks the end of the air blowing, except that in FIG. 3 a heavy weft thread 10 is transported.

Referring to FIG. 2, the air supply to the relay nozzles R1 to R5 of group I begins at ten milliseconds and ends at about twenty-five milliseconds. Therefore, the air supply to group I is controlled with an impulse length of about fifteen milliseconds. The air supply to relay nozzles R6 to R9 of group II begins at about fifteen milliseconds and ends at about thirty milliseconds. Hence, the duration of the air supply to the second group II is also about fifteen milliseconds. The same applies approximately to groups III and IV. The increase in the vertical spacing between lines 26 and 27 from left to right indicates that the duration of the air supply to the nozzle groups increases from the insertion end to the exit end of the air weft thread insertion channel. For example, the air supply to the last two groups VI and VII continues for about twenty seconds each. The insertion of the light weft thread 9 is completed at about sixty milliseconds.

FIG. 3 shows, as compared to the diagram of FIG. 2, a modified picture, whereby it will be recognized that the straight lines 26', 27' are steeper than the respective lines 26, 27 in FIG. 2. This steepness shows that it takes longer to insert a heavier weft thread 10 than a lighter weft thread 9. As a result, heavier weft threads have an increased air requirement. It is further recognizable that in the range of the stretching phase, that is along groups V to VII, the duration of the air supply pulses is lengthened at 28, 29, 30 for thus carrying and stretching the heavy weft thread 10. The insertion of the heavy weft thread is completed at about sixty-eight milliseconds and the last air pulse duration for group VII in FIG. 3 is about twenty-seven milliseconds. Especially, line 27' has been drawn as an approximation straight line rather than a curve passing through the intersections between the vertical dashed lines separating the groups and the horizontal lines indicating the end of the air supply to the respective nozzle group.

The invention teaches modifying in a control device 18 yarn specific values manually entered through keyboard 19 into a memory of the control device 18, by currently measured air effectiveness representing values of the respective yarns forming the weft threads. The so modified values are used to provide respective control signals for controlling the durations of the air supply to the respective relay nozzle groups.

The invention provides the essential advantage that heavy and light yarns can be woven automatically in the same weaving operation at a high quality and at a low air consumption.

According to a modification of the invention the parameter of the air effectiveness is calculated by a recognition of the yarn behavior in the air insertion channel. More specifically in this embodiment the yarn speed in the air insertion channel is measured with the aid of a light barrier and based on this speed, the duration of the impulses is controlled through the control device 18.

Although the invention has been described with reference to specific example embodiments it will be appreciated that it is intended to cover all modifications and equivalents within the scope of the appended claims.

We claim:

1. An apparatus for controlling an air supply to nozzle means for inserting weft threads of different yarn types into a respective shed in the air jet loom, comprising a control device for producing a valve control signal, said control device having stored therein specific yarn parameters representing said different yarn types, said control signal being produced in accordance with said specific yarn parameters, electrically controllable valve means for supplying pressurized air to said nozzle means, control conductor means connecting said valve means to said control device for controlling a duration during which said valve means are switched open to produce air jets of respective durations in response to said control signal, sensor means arranged to sense values representing a present air effectiveness for each yarn prior to said inserting, further conductor means connecting said sensor means to said control device to form a closed loop control circuit for supplying said present air effectiveness values to said control device which modifies said control signal in accordance with said present air effectiveness values, whereby said control signal is formed in response to said stored specific yarn parameters and modified in response to said present air effectiveness values.

2. The apparatus of claim 1, wherein said sensor means comprise means for measuring a thickness of said yarns, said thickness representing said present air effectiveness.

3. The apparatus of claim 2, wherein said sensor means comprise a capacitive sensor for measuring the thickness of each weft thread.

4. The apparatus of claim 1 wherein said nozzle means comprise relay nozzle means and main insertion nozzle means, said relay nozzle means being arranged in groups along a weft thread air insertion channel, said valve means comprising a separate valve for each relay nozzle group and at least one separate valve for said main insertion nozzle means.

5. The apparatus of claim 1, wherein said sensor means are arranged upstream of an air insertion channel as viewed in a movement direction of said weft thread, whereby said sensor means provide information to said control device as to when a weft thread enters into said air insertion channel.

* * * * *